United States Patent [19]

Davies et al.

[11] Patent Number: 4,632,675

[45] Date of Patent: Dec. 30, 1986

[54] PROCESS FOR STABILIZATION OF COAL LIQUID FRACTIONS

[75] Inventors: Geoffrey Davies, Lexington; Ahmed El-Toukhy, Dorchester, both of Mass.

[73] Assignee: Northeastern University, Boston, Mass.

[21] Appl. No.: 640,012

[22] Filed: Aug. 10, 1984

[51] Int. Cl.[4] ..... C10L 1/22

[52] U.S. Cl. ..... 44/72; 44/77; 208/428

[58] Field of Search ..... 44/50, 51, 53, 56, 72; 208/8 LE

[56] References Cited

U.S. PATENT DOCUMENTS

| | | | |
|---|---|---|---|
| 1,940,445 | 12/1933 | Calcott et al. | 44/72 |
| 1,992,014 | 2/1935 | Rogers et al. | 44/72 |
| 2,100,287 | 11/1937 | Conquest | 44/77 |
| 2,176,747 | 10/1932 | Schneider et al. | 44/77 |
| 2,219,859 | 10/1940 | White | 44/56 |
| 4,405,437 | 9/1983 | Kulik et al. | 208/8 LE |
| 4,420,930 | 12/1983 | Beuther et al. | 208/8 LE |
| 4,425,135 | 1/1984 | Jenkins | 208/8 LE |
| 4,428,818 | 1/1984 | Derbyshire et al. | 208/8 LE |

*Primary Examiner*—Y. Harris-Smith

*Attorney, Agent, or Firm*—Weingarten, Schurgin, Gagnebin & Hayes

[57] ABSTRACT

Coal liquid fractions to be used as fuels are stabilized against gum formation and viscosity increases during storage, permitting the fuel to be burned as is, without further expensive treatments to remove gums or gum-forming materials. Stabilization is accomplished by addition of cyclohexanol or other simple inexpensive secondary and tertiary alcohols, secondary and tertiary amines, and ketones to such coal liquids at levels of 5–25% by weight with respect to the coal liquid being treated. Cyclohexanol is a particularly effective and cost-efficient stabilizer. Other stabilizers are isopropanol, diphenylmethanol, tertiary butanol, dipropylamine, triethylamine, diphenylamine, ethylmethylketone, cyclohexanone, methylphenylketone, and benzophenone. Experimental data indicate that stabilization is achieved by breaking hydrogen bonds between phenols in the coal liquid, thereby preventing or retarding oxidative coupling.

13 Claims, 3 Drawing Figures

PROCESS FOR STABILIZATION OF COAL LIQUID FRACTIONS

FIELD OF THE INVENTION

This invention concerns stabilization of coal liquid fractions, and more particularly, preventing or retarding asphaltene (gum) formation and viscosity increases upon storage by addition of simple inexpensive chemicals.

BACKGROUND OF THE INVENTION

Coal-derived liquid fuels have obvious advantages over other coal forms as energy sources. However, coal liquid fuels are known to deteriorate with time, the molecular weight, oxygen content, asphaltene (gum) content, and viscosity all increasing on processing and storage. See, for example, Frankenfeld, J. W. and Taylor, W. F., *Am. Chem. Soc., Div. Fuel Chem. Prepr.*, 23 (4), 205 (1978); Lin, Y. Y., Anderson, L. L. and Wiser, W. H., *Am. Chem. Soc., Div. Fuel Chem. Prepr.*, 19 (5), 2 (1974); Finseth, D., Hough, W., Queiser, J. A. and Retcofsky, H. L., *Am. Chem. Soc., Div. Petrol. Chem. Prepr.*, 24 (4), 979 (1979); Brown, F. R. and Karn, F. S., *Fuel*, 59, 431 (1980); Kershaw, J. R. and Gray, D., *Fuel*, 59, 436 (1980); Brinkman, D. W., Bowden, J. N., Frankenfeld, J. W. and Taylor, W. F., *Am. Chem. Soc., Div. Fuel Chem. Prepr.*, 25 (3), 110 (1980); Hara, T., Jones, L., Li, N. C. and Tewari, K. C., *Fuel*, 60, 1143 (1981).

Such deterioration adversely affects fuel handling, burner performance, and burning efficiency. Gum formation is a general phenomenon and presents serious practical problems. In the extreme case of solidification this could result in very serious problems and complete loss of the advantages of a liquid fuel.

Recent work by N. C. Li and coworkers strongly suggests that metal-catalyzed reactions of phenols with dioxygen are largely responsible for storage instability and deterioration of coal liquids. See, for example, White, C. M. and Li, N. C., *Anal. Chem.*, 54, 1564 (1982); White, C. M. and Li, N. C., *Anal. Chem.*, 54, 1570 (1982); Jones, L. and Li, N. C., *Fuel*, 62, 1156 (1983); White, C. M., Jones, L. and Li, N. C., *Fuel*, 62, 1397 (1983). The investigations of these workers have shown that phenolic constituents in coal liquid fractions are coupled in the presence of dioxygen to form various polymeric ethers, and have provided direct evidence for the presence of dimers, trimers, tetramers, and pentamers derived from phenols shown to be present initially.

In the past, attempts to stabilize coal liquid fractions have focused on cost-ineffective processes to remove phenolic materials, utilizing base extraction or conversion of phenolic materials to corresponding ether derivatives. Derivatization may be carried out in situ or after separation of the phenols from the coal liquid fraction, and in the latter case the ether derivatives have sometimes been returned to the coal liquid. These processes are shown in U.S. Pat. Nos. 4,277,326; 4,277,327; 4,299,691; 4,319,981; 4,353,792; 4,382,855; 4,406,780. It is possible to precipitate gums from aged coal liquid fractions by the addition of nonpolar hydrocarbons, as shown by Jones, L. and Li, N. C., *Fuel*, 62, 1156 (1983). Another possible approach to stabilization of coal liquid fractions is to upgrade such fractions by further hydrogenation under much more severe conditions than were used in the original liquifaction process, as shown by Young, L. J. S., Li, N. C., and Hardy, D., *Fuel*, 62, 1397 (1983). The objective then is to remove all potentially oxidizable functional groups from the fuel constituents while not creating new products which are even more highly reduced and still likely to be air sensitive. This approach has also been employed in U.S. Pat. No. 4,319,981.

All of the above-described processes for stabilizing coal liquid fractions constitute additional steps in the processing of such liquids, and require plant facilities, chemicals, and energy. As a result, they inevitably increase the cost of producing stable coal liquid fractions, to a point at which these processes become prohibitively expensive.

To avoid the expense of additional processing steps in the production of stable coal liquid fractions, it is most desirable to have a stabilizing process in which stabilization is achieved by adding one or more appropriate inexpensive stabilizing agents which retard or prevent viscosity increases and gum deposition. Such a process is the subject of this invention.

SUMMARY OF THE INVENTION

It has been found that coal liquid fractions are economically and simply stabilized with regard to viscosity increases and gum deposition on storage by the addition of cyclohexanol, which has the advantages of being quite inexpensive, high-boiling, and liquid. Stabilization is achieved at levels of between 5 and 25% by weight relative to coal liquid. Certain other secondary and tertiary alcohols, secondary and tertiary amines, and ketones function similarly. In contrast to unstabilized coal liquid fuel fractions, which normally deposit gum and increase in viscosity under storage conditions, coal-derived fuels stabilized according to the invention do not deposit gums, and exhibit only slight or negligible increases in viscosity upon storage in sealed containers at temperatures of up to 50° C. The process has the important advantages of requiring no special equipment and being of very low cost.

BRIEF DESCRIPTION OF THE DRAWING

The invention will be more fully understood from the following detailed description taken in conjunction with the accompanying drawing, in which.

DETAILED DESCRIPTION OF THE INVENTION

Figure 1:
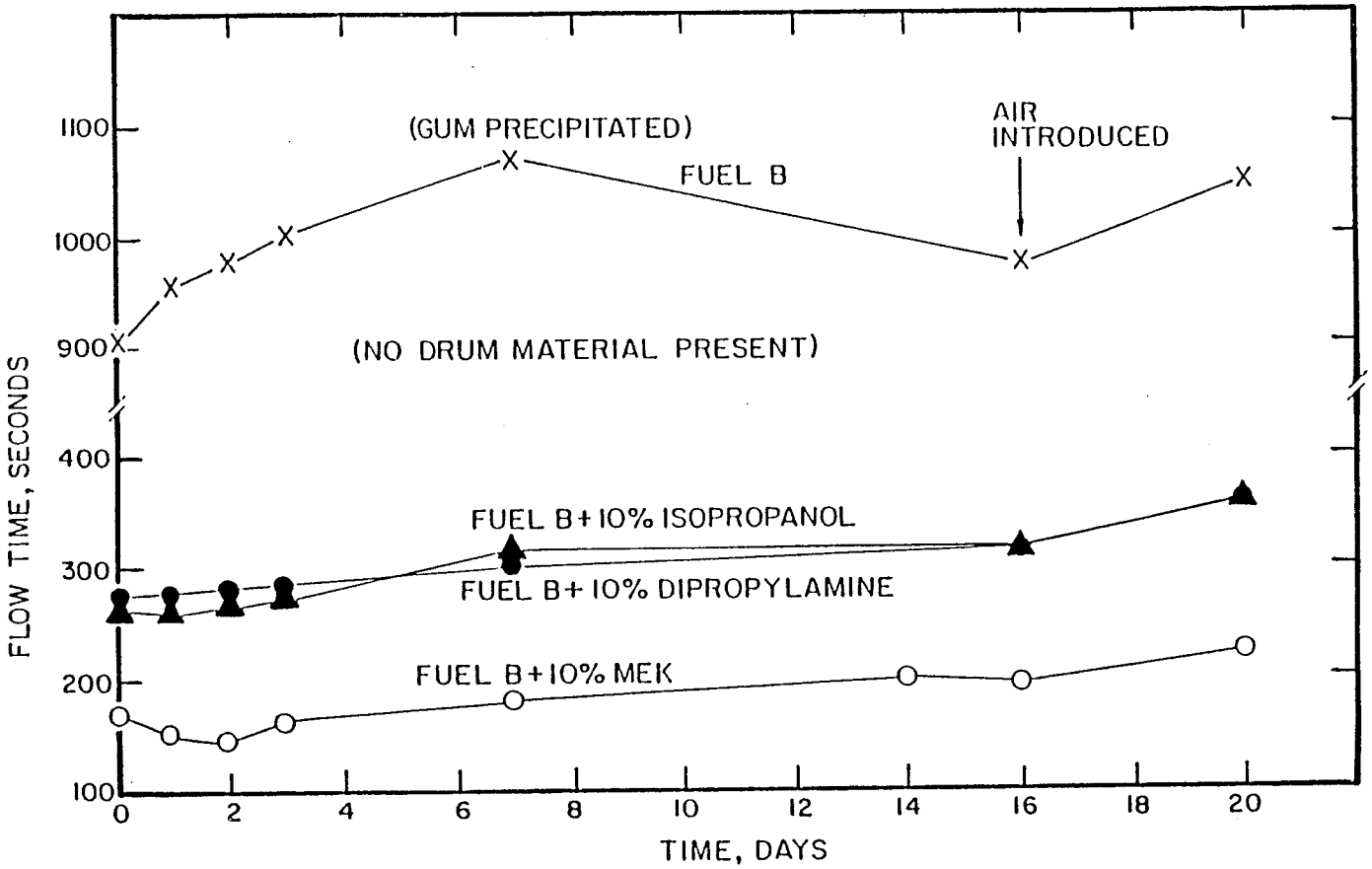
FIG. 1 is a plot of viscometer flow time vs. storage time, corresponding to the data of Table II.

Throughout this specification, the terms "coal liquid" and "coal liquid fraction" mean a liquid hydrocarbonaceous product derived from a process for liquifaction of coal.

Secondary alcohols $R_1$—CH(OH)—$R_2$ where $R_1$ and $R_2$ are phenyl, substituted phenyl, or alkyl of from 1 to 4 carbon atoms, preferably methyl, or where $R_1$ and $R_2$ are linked and taken together with the carbon to which they are attached constitute a cycloalkyl group of from 3 to 9 carbons, preferably cyclohexyl, when added to coal liquid fractions at a level of between 5 and 25% w/w, preferably 10 to 15% w/w, are effective in stabilizing such coal fractions with respect to viscosity increases and gum deposition when the mixtures are stored in sealed containers at temperatures up to at least 50° C.

Tertiary alcohols

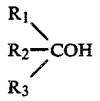

where $R_1$–$R_3$ are alkyl of from 1 to 4 carbon atoms, preferably methyl, or where $R_1$ and $R_2$ are linked and taken together with the carbon to which they are attached constitute a cycloalkyl group of from 3 to 9 carbon atoms, preferably cyclohexyl, stabilize liquid coal fractions analogously to the above-described secondary alcohols.

Secondary amines $R_1$—NH—$R_2$ where $R_1$ and $R_2$ are phenyl, substituted phenyl, or alkyl of from 2 to 4 carbons, preferably propyl, or where $R_1$ and $R_2$ are linked and taken together with the nitrogen atom to which they are attached constitute a heterocycle containing from 4 to 6 carbon atoms, when added to coal liquid fractions at levels between 5 and 25% w/w, preferably between 10 and 15% w/w, are effective in stabilizing such coal fractions with respect to viscosity increases and gum deposition when the mixtures are stored in sealed containers at temperatures up to at least 50° C.

Tertiary amines

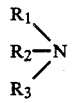

where $R_1$–$R_3$ are alkyl of from 1 to 4 carbon atoms, preferably ethyl, or where $R_1$ and $R_2$ are linked and taken together with the nitrogen atom to which they are attached constitute a heterocycle containing from 4 to 6 carbon atoms, stabilize coal liquid fractions analogously to the above-described secondary amines.

Ketones $R_1$—CO—$R_2$ where $R_1$ and $R_2$ are phenyl, substituted phenyl, or alkyl of from 1 to 3 carbon atoms, preferably methyl or ethyl, or where $R_1$ and $R_2$ are linked and taken together with the carbon to which they are attached constitute a cycloalkyl group of from 4 to 9 carbon atoms, for example cyclohexanone, when added to coal liquid fractions at levels between 5 and 25% w/w, preferably between 10 and 15% w/w, are effective in stabilizing such fractions with respect to viscosity increases and gum deposition when the mixtures are stored in sealed containers at temperatures up to at least 50° C.

Mixtures of two or more of the above alcohols, amines, and ketones are also effective in stabilizing liquid coal fractions.

Experimental Results Showing Stabilization of Coal Liquids Against Gum Formation and Viscosity Increases on Storage Aging experiments were carried out at 50° C.±2° C. in pyrex vessels, with pyrex gas delivery tubes (for flowing gas experiments) or tightly fitted stoppers (for headspace experiments). Drum material was cut from standard steel drums. Additives were used as received.

Viscosity measurements were made at 20° C.±0.05° C. using ASTM standard equipment with chloroform and nitrobenzene as standards. $^1$H NMR spectra were obtained with a JEOL Model FX60Q spectrometer at 25° C. with TMS as internal reference. Infrared spectra were recorded for samples as thin films on sodium chloride plates on a Perkin Elmer Model 567 spectrometer calibrated with the 906.5 or 3026.3 $cm^{-1}$ absorptions of polystyrene.

Elemental analyses of coal liquids were made by MultiChem Laboratories, Lowell, Mass. Freezing point constants $K_f$ for nitrobenzene (7.0° C./molal) and cyclohexanol (30.7° C./molal) were determined with benzil as the standard. These freezing point constants were used for cryoscopic determination of the average molecular weights of coal liquid fractions and gums precipitated from them.

Coal liquid fractions A, B, and C, derived from Illinois Number 6 coal, were obtained from Catalytic, Inc., Wilsonville, Ala. They were flushed with dinitrogen and stored at 0° C. in their shipping drums. The viscosities of fractions A and B were shown to be stable under these conditions over a 90-day period. Analytical and other data for these middle distillate fractions are given in Table I below.

TABLE I

Physical Properties of Coal Liquid Fractions

| Fuel | A | B | C |
|---|---|---|---|
| Code # | 16814 | 16815 | 23156 |
| Boiling Range, °F. | 450–650 | 650-E.P.* | 650-E.P.* |
| Specific Gravity | 0.991 | 1.009 | 1.255 |
| Initial Viscosity (m poise) | 740 | 1960 | 7880 |
| % (w/w) Gum present | 3.0 | 4.5 | 6.0 |
| % C (liquid coal) | 88.0 | 88.2 | 88.6 |
| % C (Gum from liquid) | 80.1 | 82.2 | 82.3 |
| % H (liquid coal) | 10.1 | 9.8 | 9.5 |
| % H (Gum from liquid) | 7.4 | 7.6 | 7.0 |
| % N (liquid coal) | 0.28 | 0.45 | 0.50 |
| % N (Gum from liquid) | 1.95 | 2.00 | 2.17 |
| % S (Liquid coal) | 0.23 | 0.73 | 1.28 |
| % S (Gum from liquid) | 1.02 | 0.89 | 0.96 |

*end of the distillation

Preparation of Gum-free Coal Liquid Fractions

Pentane was added with stirring to a portion of liquid coal fraction B until its weight in the mixture reached 80% of the weight of coal liquid employed. The mixture was then stirred at room temperature overnight, during which time gum precipitated on the container walls. The supernatant liquid was decanted from the precipitate, and pentane was removed under vacuum on a rotary evaporator at room temperature, yielding low viscosity gum-free B ($GFB_1$).

Upon distilling pentane at atmospheric pressure from the pentane-fuel supernatant solution, or heating $GFB_1$ in air at 50° C., a higher-viscosity gum-free material was produced, $GFB_2$. Material $GFB_2$ was found to have a specific gravity of 0.989, an initial viscosity of 959 mp, and elemental analyses of 88.6% C., 10.0% H, 0.24% N, and 0.10% S.

The precipitated gum was washed twice with pentane, and weighed by subtracting the weight of the container from the combined weight of the container and gum. Gum content was found to be consistent from preparation to preparation, averaging 4.5±0.1% for liquid coal B.

Gum-free A and gum-free C were similarly prepared from coal liquid fractions A and C by addition of pentane at levels of 85% and 75% by weight, respectively. Gum-free coal liquid fractions prepared in this way do not precipitate further gums during testing or storage, even in the presence of dioxygen. Material $GFA_2$ was found to have a specific gravity of 0.984 and elemental analyses of 88.0% C, 10.2% H, 0.33% N, and 0.18% S.

EXAMPLE 1

Stabilization of Coal Liquid Fraction B by Additives

Separate aliquots of coal liquid fraction B were treated with isopropanol, dipropylamine, and ethylmethylketone, respectively, at a level of 10% by weight. The solutions were then stored in tightly-stoppered flasks at 50° C. and the viscosities of samples taken at various times are determined. An aliquot of coal liquid fraction B was similarly stored and tested, as a control. During the test the control precipitated gum, but the stabilized test mixtures did not. After sixteen days, the solutions were exposed to flowing ambient air to test gum prevention and viscosity stabilization under non-storage conditions. Results are shown in Table II, and FIG. 1. It is apparent that the presence of stabilizing additives reduces the viscosity of the coal liquid fraction, prevents substantial viscosity increases in the stored coal liquid fraction initially and over time, and prevents gum precipitation.

TABLE II

Flow Times (sec.) for Fuel B and Fuel B plus Additives Under Simulated Storage Conditions, and under Non-Storage Conditions

| | Fuel B[a] | Fuel B + 10% isopropanol[b] | Fuel B + 10% MEK[c] | Fuel B + 10% dipropylamine[d] |
|---|---|---|---|---|
| initial | 906 | 260 | 170 | 275 |
| 1 day | 960 | 260 | 155 | 276 |
| 2 days | 980 | 265 | 145 | 280 |
| 3 days | 1005 | 275 | 163 | 285 |
| 7 days | 1070 | 315 | 180 | 300 |
| 14 days | — | — | 198 | — |
| 16 days* | 975 | 330 | 195 | 330 |
| 20 days | 1095 | 365 | 210 | 365 |

[a]gum precipitated
[b]boiling point = 82° C.
[c]methylethylketone; boiling point = 80° C.
[d]boiling point = 84° C.
*air flow started Several additional materials were evaluated according to the procedure of Example I except that flow times were measured only at the beginning and the end of the test period, and flowing air was not introduced. During the test the control precipitated gum, but the stabilized test mixtures did not. Results are shown in Table III.

TABLE III

Time-dependent Flow Times (t, sec) of Fuel B and Fuel B/10% Additive Mixtures

| Additive[a] | b.p. °C. | $t_o$[b] | $t_t$[c] |
|---|---|---|---|
| none | — | 460 | 511[d] |
| t-butanol | 83 | 177 | 255 |
| t-butanol, 5%/cyclohexanol, 5% | — | 198 | 202 |
| diphenylmethanol | 297 | 435 | 458 |
| triethylamine | 88 | 74 | 83 |
| diphenylamine | 302 | 303 | 339 |
| methylphenylketone | 202 | 180 | 210 |
| benzophenone | 305 | 367 | 446 |

[a]No gum deposition in the presence of additives
[b]time = 0
[c]time = 12 days
[d]Gum deposited

EXAMPLE II

Figure 2:
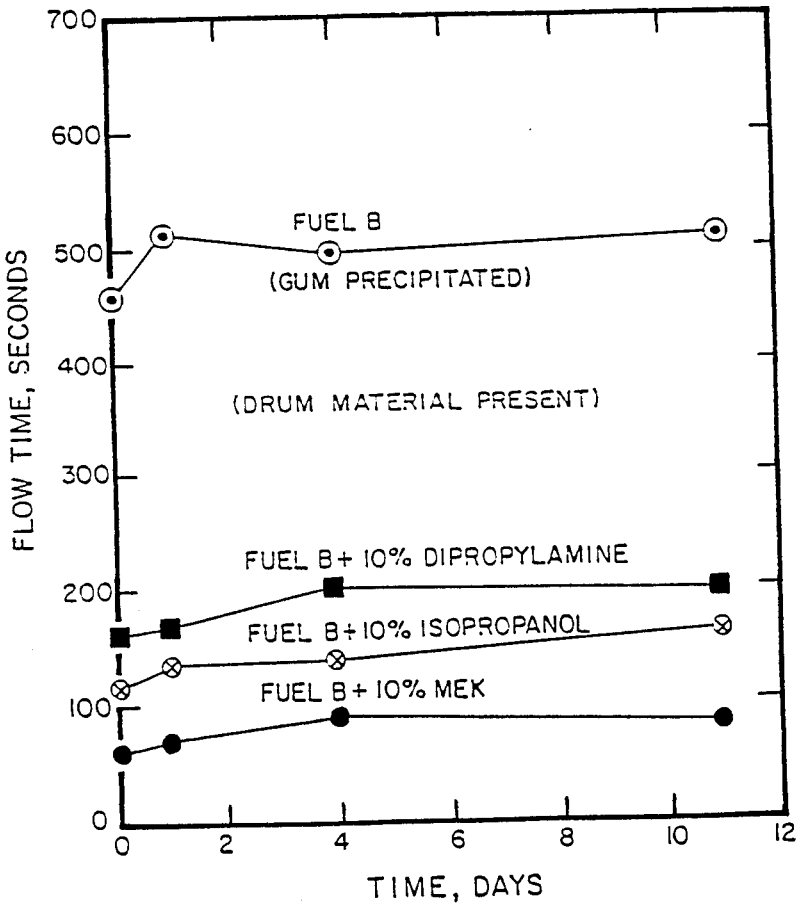
FIG. 2 is a plot of viscometer flow time vs. storage time, corresponding to the data of Table IV.

Stabilization of Coal Liquid Fraction B by Additives in the Presence of Drum Material The experiment of Example I was repeated with drum material (typically 1.2 g cut in narrow strips) present, for eleven days. No test with air was included. Untreated fuel B precipitated gum during the test, but stabilized test mixtures did not. Results are shown in Table IV, and FIG. 2. As found in the tests of Example I, the presence of stabilizing additives reduces the viscosity of the coal liquid fraction, prevents substantial viscosity increases in the stored coal liquid fraction initially and over time, and prevents gum precipitation.

TABLE IV

Flow Times (sec.) for Fuel B and Fuel B plus Additives Under Simulated Storage Conditions with Drum Material Present

| | Fuel B[a] | Fuel B + 10% isopropanol | Fuel B + 10% MEK[b] | Fuel B + 10% dipropylamine |
|---|---|---|---|---|
| initial | 460 | 110 | 62 | 159 |
| 1 day | 515 | 130 | 70 | 168 |
| 4 days | 500 | 140 | 80 | 200 |
| 11 days | 520 | 165 | 82 | 195 |

[a]gum precipitated
[b]methylethylketone

EXAMPLE III

Stabilization of Gum-free Coal Liquid B by Additives

Figure 3:
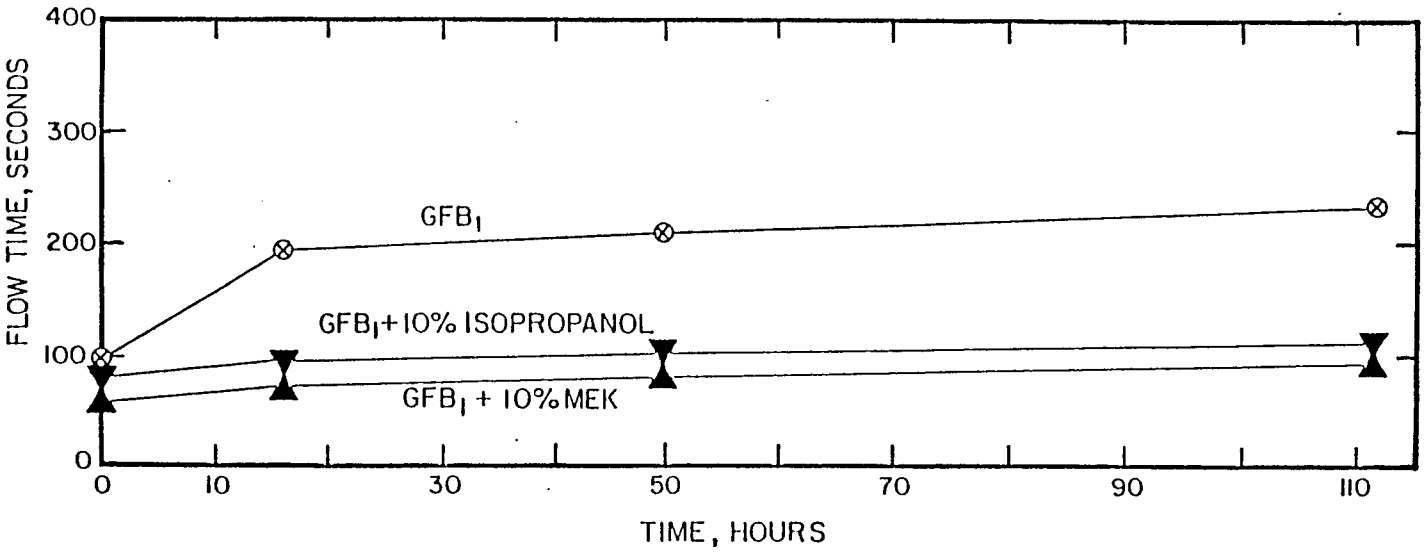
FIG. 3 is a plot of viscometer flow time vs. storage time, corresponding to the data of Table V.

Separate aliquots of gum-free coal liquid B ($GFB_1$) were treated with isopropanol, and ethylmethylketone, at a level of 10% by weight. The solutions were then stored in tightly stoppered flasks at 50° C. and the viscosities of samples taken at various times were determined. An aliquot of $GFB_1$ was similarly stored and tested, as a control. Results are shown in Table V, and FIG. 3. It is apparent that the presence of stabilizing additives prevents the rapid initial viscosity increase seen in the unstabilized fuel.

TABLE V

Flow Times (sec.) for $GFB_1$ and $GFB_1$ Plus Additives Under Simulated Storage Conditions

| | $GEB_1$ | $GFB_1$ + 10% isopropanol | $GFB_1$ + 10% MEK[a] |
|---|---|---|---|
| 15 hr | 238 | 78 | 56 |
| 50 hr | 490 | 92 | 66 |
| 110 hr | 600 | 110 | 88 |

[a]methylethylketone

EXAMPLE IV

Stabilization of Coal Liquid Fraction A, B, and C by Cyclohexanol

Aliquots of Coal Liquid Fractions A, B, and C were treated with cyclohexanol (b.p. 160° C.) at levels of 10%, 10% and 15% by weight, respectively. The solutions were then stored in tightly-stoppered flasks at 50° C. and the viscosities were determined after three weeks. Results are shown in Table VI. It is apparent that cyclohexanol-stabilized coal liquid fractions show only small increases in viscosity upon storage, while the corresponding unstabilized materials showed relatively much larger viscosity increases, and also precipitated gums. Note that cyclohexanol stabilized effectively even in the presence of an added phenolic oxidative coupling initiator.

TABLE VI

Time-dependent Viscosities of Fuel and Fuel/Cyclohexanol Mixtures

| Fuel | % w/w Cyclohexanol | Specific Gravity | $\eta_o$, [a,b] m Poise | $\eta_t$, [a,c] m Poise |
|---|---|---|---|---|
| A | 0 | 0.991 | 740(20) | 845(35)[d] |
| | 10 | 0.987 | 578(15) | 583(20) |
| | 10[e] | 0.985 | 560(20) | 580(15) |
| B | 0 | 1.009 | 1960(20) | 2325(40)[d] |

TABLE VI-continued

Time-dependent Viscosities of Fuel and Fuel/Cyclohexanol Mixtures

| Fuel | % w/w Cyclohexanol | Specific Gravity | $\eta_o$, [a,b] m Poise | $\eta_t$, [a,c] m Poise |
|---|---|---|---|---|
| | 10 | 0.994 | 1490(10) | 1550(25) |
| C | 0 | 1.255 | 7880(30) | 10490(40)[d] |
| | 15 | 1.000 | 2920(20) | 3100(20) |

[a]Viscosity measured at 20.00° C.; numbers in parentheses are 1 standard deviation.
[b]time = 0
[c]time = 21 days at 50° C. in presence of steel drum material.
[d]Gum deposition was observed in all experiments with no added cyclohexanol. No gum was deposited in any experiment with added cyclohexanol.
[e]Added phenolic oxidative coupling initiator: $[pyCuCl]_4O_2 = 1 \times 10^{-4}$ M (Davies, G. and El-Sayed, M.A., Inorg. Chem., 22, 1257 (1983)).

Mechanistic Considerations

While not wishing to be bound by theory, it is believed that the advantageous results obtained by using cyclohexanol to stabilize coal liquid fractions are obtained because cyclohexanol forms hydrogen bonds with phenols in the coal liquid fractions, thereby breaking hydrogen bond interactions between the phenols themselves, and retarding or preventing the phenols from undergoing oxidative polymerization. This hypothesis is based on the following experimental data:

a. The viscosity of samples of coal liquid fraction B containing progressively larger amounts of cyclohexanol decreased to a broad minimum at about 70% w/w cyclohexanol. No such minimum was observed for similar samples of fuel B in nitrobenzene, and the measured viscosity at 70% nitrobenzene was much lower, suggesting a specific interaction between some constituents of liquid coal fraction B and cyclohexanol.

b. When 25 parts of coal liquid fraction B and 70 parts of cyclohexanol were mixed with 5 parts of either phenol or pyridine, and the viscosities compared with the viscosity of a 25/70/5 fuel/cyclohexanol/cyclohexane mixture, it was found that the presence of phenol increased the flow time while pyridine decreased it, relative to the mixture with cyclohexane. It is concluded that cyclohexanol hydrogen bonds with phenols in the fuel.

c. Comparison of the infrared spectra of coal liquid fractions A, B, $GFA_2$, and $GFB_2$, and the corresponding pentane-precipitated gums showed that $\nu$—OH($\sim$3400 $cm^1$) and $\nu$—C═N($\sim$1590 $cm^{-1}$) functions are concentrated in the gums. The infrared bands corresponding to the —OH and —C═N functions of the liquid fuels are shifted by $\pm$(5–15) $cm^{-1}$ on addition of 10% w/w cyclohexanol, again suggesting physical cyclohexanol-fuel interactions.

d. A comparison of the proton NMR spectra of cyclohexanol, coal liquid fraction B, and a mixture of coal liquid fraction B+10% w/w cyclohexanol showed that in the mixture, peaks corresponding to both fuel and cyclohexanol were shifted downfield and broadened relative to the same peaks in the spectra of fuel and cyclohexanol alone. This corresponds to proton deshielding expected for cyclohexanol-fuel interactions.

e. Molecular weights of gums (from A and B), $GFA_2$, $GFB_2$, A and B were measured cryoscopically in nitrobenzene ($K_f$ 7.0° C./molal) and in cyclohexanol ($K_f$ 30.7). In nitrobenzene, gum averaged 390–420 daltons, while the liquid fuel averages were in the range 300–345 daltons. The measured molecular weights A and B were lower in cyclohexanol (average 190–220 daltons) than in nitrobenzene, again indicating that cyclohexanol disrupts specific interactions between fuel components.

It is believed that as all the additives of the invention are capable of hydrogen bonding, the explanation given above for the case of cyclohexanol applies to such other additives as well.

It is to be noted that higher boiling additives are preferred because they are less easily lost by volatilization than are more volatile additives. Also, the effectiveness of an additive is a function of its molecular weight, the molar ratio of additive to fuel constituents having a bearing on the extent of additive-fuel constituent interactions. Cyclohexanol is a particularly good additive in view of these considerations since it is both relatively low molecular weight and relatively high boiling, as well as inexpensive.

Although the invention has been exemplified with coal liquid fractions derived from Illinois Number 6 coal, coal liquids derived from other coals are similarly stabilized. The invention is not to be limited by what has been particularly shown and described, except as indicated by the appended claims.

What is claimed is:

1. A process for stabilizing coal liquid fractions with respect to viscosity increases and gum deposition, comprising:

adding cyclohexanol to a coal liquid fraction at a level of from 5 to 25% by weight of the coal liquid, and storing said liquid coal-cyclohexanol mixture in a sealed container.

2. The process of claim 1 wherein cyclohexanol is added to the coal liquid at a level of from 10 to 15% by weight of the coal liquid.

3. A coal liquid composition stabilized against viscosity increases and gum deposition in storage, consisting essentially of:

a coal liquid fraction; and cyclohexanol mixed at a level of between 5 and 25% by weight with said coal liquid fraction.

4. The coal liquid composition of claim 3 wherein the amount of cyclohexanol is between 10 and 15% by weight of the coal liquid fraction.

5. A process for stabilizing coal liquid fractions with respect to viscosity increases and gum deposition, comprising:

adding to a coal liquid fraction 5 to 25% by weight of at least one compound selected from the group of additives consisting of diphenylmethanol, isopropanol, cyclohexanol, tertiary butanol, diphenylamine, dipropylamine, triethylamine, benzophenone, methylphenylketone, cyclohexanone, and ethylmethylketone; and storing the mixture of coal liquid fraction and additive in a sealed container.

6. The process of claim 5 wherein the additive is added to the coal liquid at a level of from 10 to 15% by weight of the coal liquid.

7. A coal liquid composition stabilized against viscosity increases and gum deposition in storage, consisting essentially of:

a coal liquid fraction; and at least one compound selected from the group of additives consisting of diphenylmethanol, isopropanol, cyclohexanol, tertiary butanol, diphenylamine, dipropylamine, triethylamine, benzophenone, methylphenylketone, cyclohexanone, and ethylmethylketone;

said additive being mixed at a level of between 5% and 25% by weight with said coal liquid fraction.

8. The coal liquid composition of claim 7 wherein the amount of additive is between 10 and 15% by weight of the coal liquid fraction.

9. A process for stabilizing coal liquid fractions with respect to viscosity increases and gum deposition, comprising:

adding to a coal liquid fraction 5 to 25% by weight of at least one compound selected from the group of additives consisting of:

secondary alcohols $R_1$—CHOH—$R_2$ in which $R_1$ and $R_2$ are phenyl, or alkyl of from 1 to 4 carbon atoms, or in which $R_1$ and $R_2$ are linked and taken together with the carbon atom to which they are attached constitute cycloalkyl of from 3 to 9 carbon atoms, tertiary alcohols

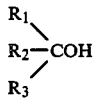

in which $R_1$–$R_3$ are alkyl of from 1 to 4 carbon atoms or in which $R_1$ and $R_2$ are linked and taken together with the carbon atom to which they are attached constitute cycloalkyl of from 3 to 9 carbon atoms, secondary amines $R_1$—NH—$R_2$ in which $R_1$ and $R_2$ are phenyl, or alkyl of from 2 to 4 carbon atoms, or in which $R_1$ and $R_2$ are linked and taken together with the nitrogen atom to which they are attached constitute a heterocycle containing 4 to 6 carbon atoms, tertiary amines

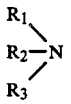

in which $R_1$–$R_3$ are alkyl of from 1 to 4 carbon atoms, or in which $R_1$ and $R_2$ are linked and taken together with the nitrogen atom to which they are attached constitute a heterocycle containing from 4 to 6 carbon atoms, and ketones $R_1$—CO—$R_2$ in which $R_1$ and $R_2$ are phenyl, or alkyl of from 1 to 3 carbon atoms, or in which $R_1$ and $R_2$ are linked and taken together with the carbon atom to which they are attached constitute a cycloalkyl group of from 4 to 9 carbon atoms; and storing the mixture of coal liquid fraction and additive in a sealed container.

10. The process of claim 9 wherein the amount of additive is from 10 to 15% by weight of the coal liquid.

11. A coal liquid composition stabilized against viscosity increases and gum deposition in storage, consisting essentially of:

a coal liquid fraction; and at least one additive selected from the group of additives consisting of secondary alcohols $R_1$—CHOH—$R_2$ in which $R_1$ and $R_2$ are phenyl, or alkyl of from 1 to 4 carbon atoms, or in which $R_1$ and $R_2$ are linked and taken together with the carbon atom to which they are attached constitute cycloalkyl of from 3 to 9 carbon atoms, tertiary alcohols

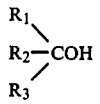

in which $R_1$–$R_3$ are alkyl of from 1 to 4 carbon atoms or in which $R_1$ and $R_2$ are linked and taken together with the carbon atom to which they are attached constitute cycloalkyl of from 3 to 9 carbon atoms, secondary amines $R_1$—NH—$R_2$ in which $R_1$ and $R_2$ are phenyl, or alkyl of from 2 to 4 carbon atoms, or in which $R_1$ and $R_2$ are linked and taken together with the nitrogen atom to which they are attached constitute a heterocycle containing 4 to 6 carbon atoms, and tertiary amines

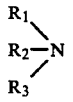

in which $R_1$–$R_3$ are alkyl of from 1 to 4 carbon atoms, or in which $R_1$ and $R_2$ are linked and taken together with the nitrogen atom to which they are attached constitute a heterocycle containing from 4 to 6 carbon atoms, and ketones $R_1$—CO—$R_2$ in which $R_1$ and $R_2$ are phenyl, or alkyl of from 1 to 3 carbon atoms, or in which $R_1$ and $R_2$ are linked and taken together with the carbon atom to which they are attached constitute a cycloalkyl group of from 4 to 9 carbon atoms;

said additive being mixed at a level of between 5 and 25% by weight with said coal liquid fraction.

12. The coal liquid composition of claim 11 wherein the amount of additive is between 10 and 15% by weight of the coal liquid fraction.

13. A process for stabilizing viscosity in coal liquid fractions from which gums have been removed, comprising:

adding to a coal liquid fraction from which gums have been removed 5 to 25% by weight of at least one compound selected from the group of additives consisting of secondary alcohols $R_1$—CHOH—$R_2$ in which $R_1$ and $R_2$ are phenyl, or alkyl of from 1 to 4 carbon atoms, or in which $R_1$ and $R_2$ are linked and taken together with the carbon atom to which they are attached constitute cycloalkyl of from 3 to 9 carbon atoms, tertiary alcohols

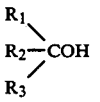

in which $R_1$–$R_3$ are alkyl of from 1 to 4 carbon atoms or in which $R_1$ and $R_2$ are linked and taken together with the carbon atom to which they are attached constitute cycloalkyl of from 3 to 9 carbon atoms, secondary amines $R_1$—NH—$R_2$ in which $R_1$ and $R_2$ are phenyl, substituted phenyl, or alkyl of from 2 to 4 carbon atoms, or in which $R_1$ and $R_2$ are linked and taken together with the nitrogen atom to which they are attached constitute a heterocycle containing 4 to 6 carbon atoms, and tertiary amines

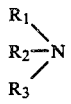

in which $R_1$–$R_3$ are alkyl of from 1 to 4 carbon atoms, or in which $R_1$ and $R_2$ are linked and taken together with the nitrogen atom to which they are attached constitute a heterocycle containing from 4 to 6 carbon atoms, and ketones $R_1$—CO—$R_2$ in which $R_1$ and $R_2$ are phenyl, or alkyl of from 1 to 3 carbon atoms, or in which $R_1$ and $R_2$ are linked and taken together with the carbon atom to which they are attached constitute a cycloalkyl group of from 4 to 9 carbon atoms; and storing the mixture of coal liquid fraction and additive in a sealed container.

* * * * *

UNITED STATES PATENT AND TRADEMARK OFFICE

CERTIFICATE OF CORRECTION

PATENT NO. : 4,632,675

DATED : December 30, 1986

INVENTOR(S) : Geoffrey Davies, et al

It is certified that error appears in the above-identified patent and that said Letters Patent is hereby corrected as shown below:

Column 1, line 4, before "Field of the Invention", this paragraph should be added:

--This invention was made with Government support under Contract No. DE-FG22-83-PC60793 awarded by the Department of Energy. The Government has certain rights to this invention.--

Column 3, line 66, "standards. $^1$H NMR", (start new paragraph with "$^1$H NMR).

Column 4, line 36, "*end of" should read --*end point of--.

Column 5, line 9, "times are" should read --times were--.

Column 6, line 38, "$GEB_1$" should read --$GFB_1$--.

Column 7, line 63, "weights A" should read --weights of A--.

Column 11, line 2, "phenyl, substituted phenyl, or alkyl" should read --phenyl, or aklyl--.

Signed and Sealed this

Eighth Day of March, 1988

*Attest:*

*Attesting Officer*

DONALD J. QUIGG

*Commissioner of Patents and Trademarks*